United States Patent [19]

Dorn

[11] 4,422,418

[45] Dec. 27, 1983

[54] EMERGENCY AIR SHUTDOWN SYSTEM FOR A DIESEL ENGINE

[75] Inventor: Russell J. Dorn, Aurora, Colo.

[73] Assignee: Condor Engineering & Manufacturing, Inc., Henderson, Colo.

[21] Appl. No.: 294,773

[22] Filed: Aug. 20, 1981

[51] Int. Cl.[3] ..... F02B 77/08

[52] U.S. Cl. ..... 123/198 D; 123/198 DB; 123/DIG. 11

[58] Field of Search .... 123/198 D, 198 DB, DIG. 11

[56] References Cited

U.S. PATENT DOCUMENTS

| | | | |
|---|---|---|---|
| 4,092,970 | 6/1978 | Ball et al. | 123/198 DB |
| 4,108,129 | 8/1978 | Rognon | 123/198 DB |
| 4,122,819 | 10/1978 | Moshofsky | 123/198 DB |
| 4,282,838 | 8/1981 | Davidson et al. | 123/198 DB |
| 4,329,954 | 5/1982 | Dobbs | 123/198 DB |
| 4,331,114 | 5/1982 | Karraker | 123/198 DB |

*Primary Examiner*—Ira S. Lazarus

*Attorney, Agent, or Firm*—John E. Reilly

[57] ABSTRACT

An emergency air shutdown system for diesel engines which has air intake manifold and curved discharge tubes leading into the manifold for a plurality of cylinders, the system comprising a valve member for each discharge tube and pivotal mounting means therefor to cause movement of the valve member about an axis substantially parallel to the air flow through the discharge tube between an open position outside the path of air flow and a closed position across the tube to block the air flow. Locking means are provided for keeping the valve in an open position, and activating means are provided to effect release of the locking means so as to permit rapid movement to the closed position across each tube.

13 Claims, 7 Drawing Figures

EMERGENCY AIR SHUTDOWN SYSTEM FOR A DIESEL ENGINE

This invention relates to shutoff valves and more particularly relates to an emergency air shutdown system for diesel engines and the like to block the flow of air into said engine under emergency conditions.

BACKGROUND AND FIELD OF THE INVENTION

Diesel engines pose particular problems when operated in an atmosphere or environment containing a fuel, such as, natural gas. This often occurs in oil fields where engines operating in and around oil or gas wells may be exposed to substantial quantities of gas-filled air. The engine will tend to draw the fuel/air mixture into its intake or suction side and as a result cannot be controlled by the operator so as to avoid serious overrunning and damage to the engine.

Previous attempts have been made to position a butterfly or damper valve on the intake side of the engine upstream of the intercooler or turbine sections and in many cases has caused serious damage to the engine. As a result, certain engine manufacturers have refused to permit the positioning of air cutoff valves on the intake side. On the other hand, there has been insufficient space on the discharge side leading into the intake manifold for the cylinders to position either a butterfly or damper valve. Typically, the discharge tube leading into the manifold and cylinders is necessarily horn-shaped or curved and will not accommodate a pivotal type of valve plate arrangement within the passage. Furthermore, there are plurality of discharge tubes, each of which requires controlled shutoff in the cylinders; yet it has been found that blocking of the air flow through the discharge tubes leading directly into the cylinders is far preferable to previous designs intended to shut down the air ahead of the intercooler or suction portions. It is therefore proposed to provide a novel and efficient manner and mean for selectively shutting down air flow into the cylinders in the discharge tubes leading into the cylinders and in such a way as to be completely safe and reliable in operation.

SUMMARY OF INVENTION

An object of the present invention therefore is to provide for a novel and improved emergency air shutdown system specifically adaptable for use with diesel engines.

It is another object of the present invention to provide for a novel and improved emergency air shutdown valve which is so constructed and arranged as to be conformable for disposition in the discharge tubes leading into the intake manifolds and cylinders and which can be synchronously and remotely controlled to effectively block air flow into the cylinders.

It is an additional object of the present invention to provide for an emergency air shutdown valve which is movable between a position outside of the flow passage leading into the cylinders so as not to obstruct air flow in any way to a position completely sealing the discharge tube and blocking the flow of any air therethrough.

It is an additional object of the present invention to provide for a novel and improved emergency air shutdown system for diesel engines and the like which is highly compact, comprised of a minimum number of parts and which is efficient and dependable in operation.

In accordance with the present invention, a preferred form thereof resides in an emergency air shutdown system for diesel engines of the type having an air intake manifold and curved discharge tubes leading into the manifold for a plurality of the cylinders, the shutdown system being made up of a valve member in the form of a closure plate for each discharge tube, pivotal mounting means for each closure plate which will cause movement of each closure plate about an axis substantially parallel to the air flow through the discharge tube with which it is associated between an open position outside the path of air flow and a closed position across the tube to block the air flow therethrough. Means are provided to normally lock the closure plate for each tube in an open position, and activating means are provided for each closure plate to effect the release of said locking means to permit rapid movement of said plate into the closed position across each tube.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 1:
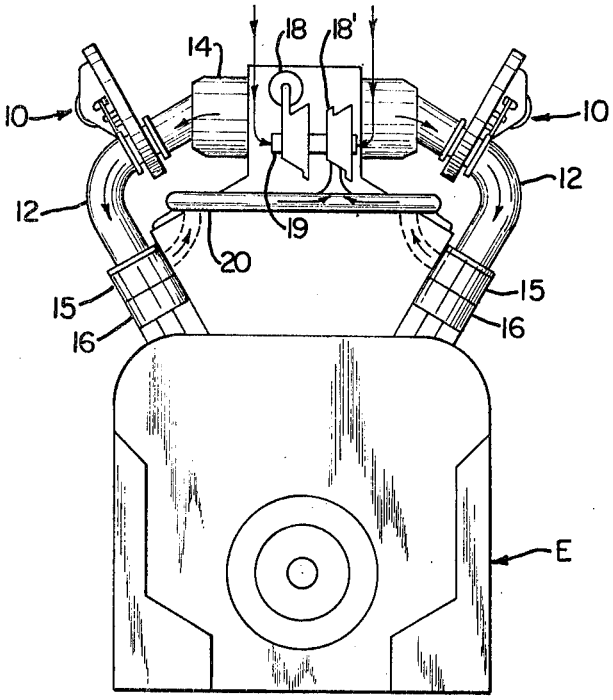
FIG. 1 is an end view of a diesel engine and illustrating the mounting and disposition of preferred forms of emergency shutdown systems in association therewith, all in accordance with the present invention.

There is shown by way of illustrative example in the drawings, a preferred form of shut-off system generally designated at 10 interpositioned in each of a series of discharge tubes 12 leading from an air box designated at 14 into air intake manifolds 15 for cylinders 16. By way of illustration but not limitation, the system 10 of the present invention is illustrated in association with a Cummins diesel engine, such as, the KTA 2300 and generally represented at E in FIG. 1. In the Cummins engine, an air tube 18 draws in fresh air through inlet 19 and discharges it into the air box or intercooler 14 under pressure, and the air box 14 in turn delivers it through the discharge tubes 12 to the intake manifolds 15. The exhaust flow of air through exhaust section 20 directs air through a turbine 18' to drive the interconnected turbines 18 and 18' for the purpose of drawing in fresh air as heretofore described through the inlet 19.

Figure 2:
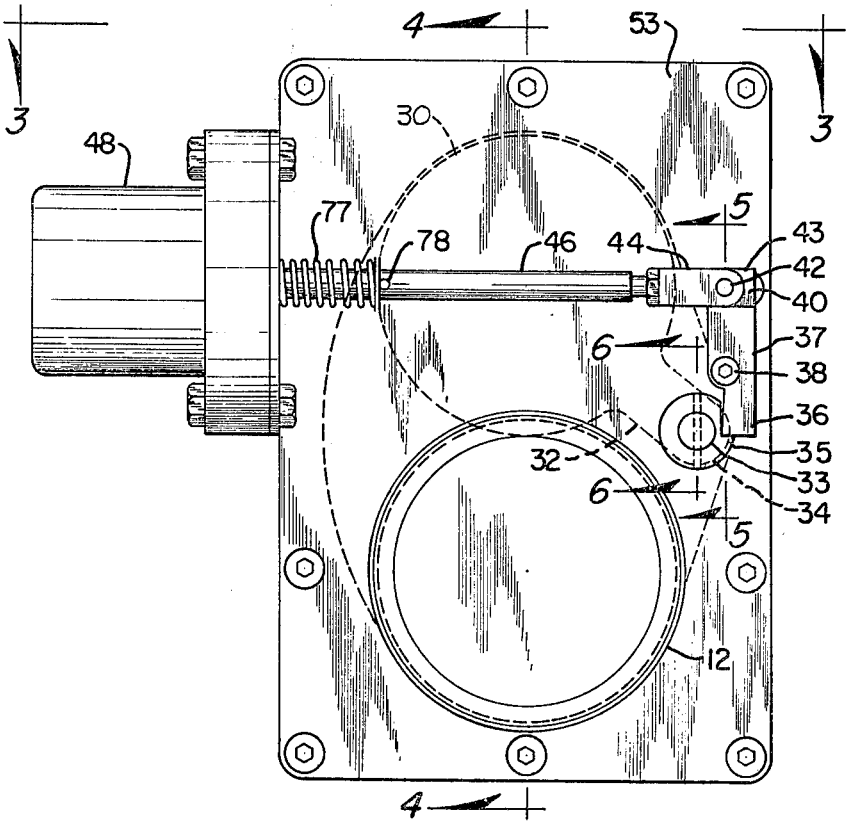
FIG. 2 is an enlarged view in more detail illustrating the movement of the emergency air shutdown system and its closure plate between open and closed positions.

Definite limitations in space are imposed on interpositioning of the emergency air shutdown system 10 in each of the discharge tubes 12. To this end, each system 10 is broadly comprised of a valve mechanism or closure plate 30 pivotally mounted by a radial extension arm 32 for rotation about a pivot pin 33 between an open position as indicated in FIG. 2 wherein the closure plate is disposed in an upwardly inclined direction above the discharge tube 12 to a closed position completely traversing the air passage through the discharge tube 12 so as to block the flow of air therethrough. Accordingly, the plate is mounted for pivotal movement about the center axis of the pin, which axis extends parallel to the longitudinal axis of the discharge tube or in other words substantially parallel to the direction of air flow through the tube so that the closure plate is capable of moving in a direction perpendicular to that of the air flow through the tube. The closure plate is normally mounted in an open position by locking means which take the form of a cam 34 mounted in outer concentric relation to the pivot pin 33 and having a shoulder 35 against which normally rests the lower end 36 of a pivot link 37 which is centrally pivoted as at 38. The pivot link has its upper end 40 pivotally connected by cross pin 42 between bifurcated ends 43 of coupling 44, the latter being threadedly connected to control arm 46 leading from solenoid 48. The solenoid serves as the activating means so that upon energization it will retract the control rod 46 to pivot the link 37 away from locking engagement with the closure plate and release the plate for movement toward the closed position as described under the urging of a torsion or clutch spring 50, as shown in FIGS. 6 and 7.

Figure 3:
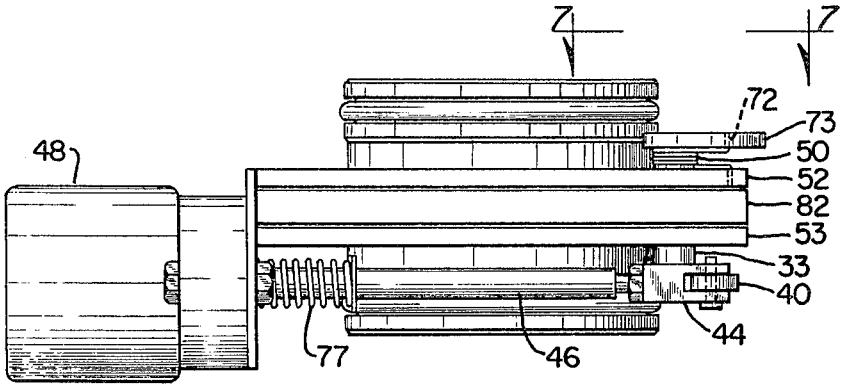
FIG. 3 is a view taken about lines 3—3 of FIG. 2.
Figure 4:
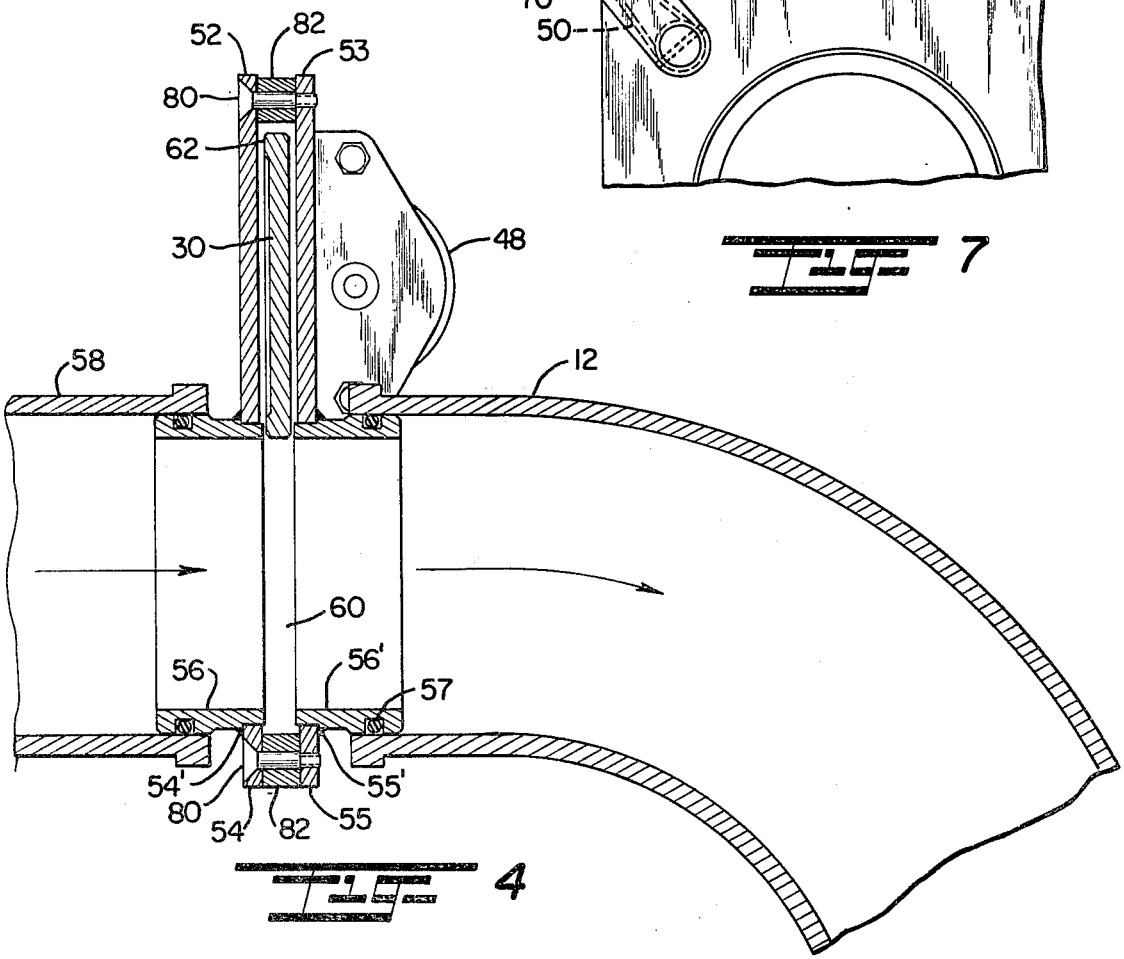
FIG. 4 is a view taken about lines 4—4 of FIG. 2.

Referring in more detail to FIGS. 3 and 4, the closure plate 30 is of generally circular configuration and is sized to correspond to the internal diameter of the discharge tube 12. Preferably, the closure plate is interpositioned between a pair of stationary plates 52 and 53 which have annular or ring-like portions 54 and 55, respectively, disposed in surrounding relation to an air tube made up of segments 56 and 56', the portions 54 and 55 being welded as at 54' and 55', respectively, to the segments 56 and 56' so as to form a sealed interconnection between an air crossover connection 58 leading from the air box and the discharge tube 12. The air tube is divided into two segments 56 and 56' as described so as to form a space or gap 60 in alignment with the closure plate. The stationary plates 52 and 53 flank opposite sides of the gap 60 and are secured together by suitable fasteners, such as, the screws 80 which are passed through the outer periphery of the plates and through a spacer ring 82 in surrounding relation to a portion of the gap 60. O-rings 57 on the external surface of each segment established sealed engagement with the inner walls of the air cross-over connection 58 and the discharge tube 12. The closure plate is of thin flat configuration having an enlarged or thickened peripheral edge 62 which is sized to effect closefitting sealed engagement with confronting edges of the air tube segments 56 and 56' when the closure plate is moved into the closed position across the air tube thereby effectively blocking air flow through the discharge tube 12.

Figure 6:
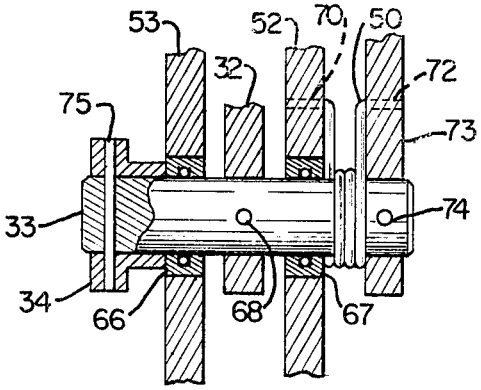
FIG. 6 is a cross-sectional view taken about lines 6—6 of FIG. 2.
Figure 7:
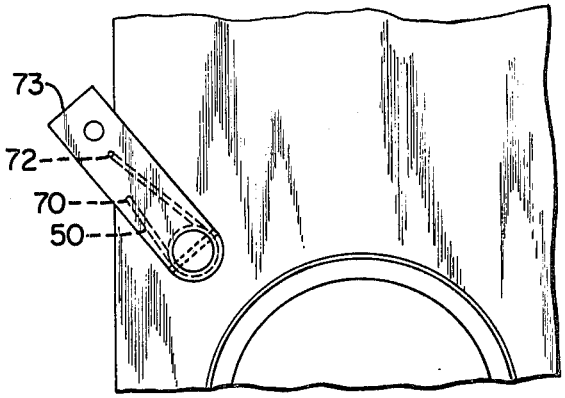
FIG. 7 is a view taken about lines 7—7 of FIG. 3.

Again, as best seen by reference to FIGS. 6 and 7, the pivot pin 33 projects through the housing plates 52 and 53, the plates being journaled on the pivot pin 33 by bearings 66 and 67, respectively, and the radial extension 32 of the closure plate is fixed for rotation with the pivot pin by means of a roll pin 68. The torsion spring 50 is coiled about the end of the pivot pin 33 opposite to the cam 34, the spring 50 having one free end 70 fixed with respect to the plate 53 and another free end 72 fixed to a control arm 73 which in turn is keyed to the pivot pin 33 by a roll pin 74. The cam 34 is fixed on the opposite end of the pin 33 by a roll pin 75.

Figure 5:
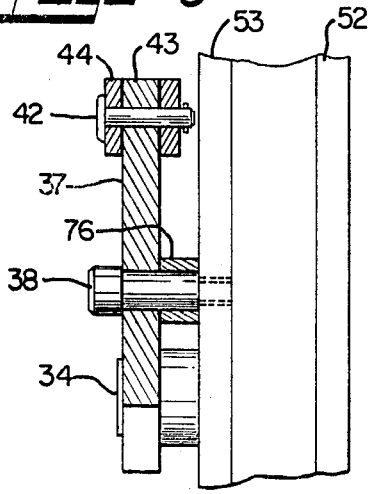
FIG. 5 is a cross-sectional view taken about lines 5—5 of FIG. 2.

FIG. 5 illustrates in more detail the mounting of the pivot link 37 on the pin 38 which is secured to the plate 53, there being a spacer 76 positioning the link 37 in outer spaced relation to the plate. The link 37 is journaled on the pin so as to be free to follow the movement of the control rod 46 with its lower end aligned with the shoulder 35 on the cam 34 under the urging of coiled spring 77 which is mounted on the control rod 46 between the solenoid housing and a stop element 78 on the control rod 46. In practice, normally the closure plate for the discharge tubes will be held in the open position as shown in FIG. 2 by virtue of the engagement of the pivot link and its lower end 36 with the shoulder 35 on the cam 34. In the open position, when the engine is running, the exhaust flow of the fuel/air mixture which passes through exhaust 20 will operate the interconnected turbines 18 and 18'. The turbines 18 and 18' will draw air into the engine air box under pressure and which air box in turn discharges the air through the discharge tubes 12 into the cylinder 16. In the event that the incoming air becomes contaminated with natural gas, such as, often occurs when the engine is being operated around oil or gas wells, an overrunning condition may occur. As soon as this condition is detected by the operator, the solenoids 48 can be activated by remote control to cause the control rods 46 to be retracted in a direction overcoming the force of the spring 77 and to pivot the lower end 36 of the pivot links 37 outwardly away from the cams 34. Upon release, the torsion spring 50 will urge the pivot pin 33 in a direction causing the extension arm 32 to be rotated downwardly to advance the closure plate 30 between the air tube segments 56 and 56' until the outer flange portion 62 of the closure plate move into full engagement or alignment with the wall of the air tubes. Accordingly, air otherwise discharged from the intercooler section will be completely blocked or cut off so as to starve combustion within the cylinders leading from the air intake manifolds 15.

In order to start the engine after it has been shut down by the emergency air shutdown system, each of the individual closure plates must be returned to their original open position. This may be accomplished in various ways but in the preferred form it is most effectively accomplished by the hand control lever 73 associated with each of the pivot pins 33. As seen from a consideration of FIG. 7, the hand control arm 73 is rotated in a counterclockwise direction to cause the closure plate to be pivoted upwardly and the shoulder 35 on cam 34 pivoted downwardly until it clears the lower end of the pivot link 37. At that time, the pivot link is returned to locking engagement with the cam under the urging or spring force of the spring 77 so as to lock the closure plate in its original open position.

While the present invention has been described specifically in connection with diesel engine emergency air shutdown systems, its ready application to other types of engines and systems will be readily appreciated. It is therefore to be understood that various modifications and changes in the construction and arrangement of parts employed in the preferred form of invention may be made without departing from the spirit and scope of the present invention as defined by the appended claims.

I claim:

1. An emergency air shutdown system for a diesel engine wherein said engine has an air intake manifold and a plurality of discharge tubes for delivery of air from an air inlet into said manifold, said system comprising:

a valve member for each discharge tube;

means mounting each said valve member for movement perpendicular to the flow of air through said associated discharge tube between an open position, externally of said associated discharge tube and outside the path of air flow therethrough, and a closed position extending across said tube to block the flow of air therethrough;

locking means normally retaining each said valve member in said open position; and activating means for each said valve member operative to advance said valve member from its normally open position to said closed position.

2. A system according to claim 1, said valve member defined by a closure plate of a size and configuration corresponding to the cross-sectional configuration of each associated discharge tube and provided with sealing means to effect a seal between said closure plate and said tube both in the open and closed positions.

3. A system according to claim 1, said mounting means defined by a pivot arm associated with each valve member and mounted for pivotal movement about an axis parallel to the flow of air through said associated discharge tube.

4. A system according to claim 3, said pivot arm being mounted for pivotal movement on a pivot pin located externally of said discharge tube, and said locking means including a cam member mounted on said pivot pin, and a pivot link normally engageable with said cam member to retain said valve member in the open position.

5. A system according to claim 4, said activating means for each said valve member including a solenoid-operated control rod engageable with said pivot link, said control rod operative when said solenoid is energized to advance said pivot link away from locking engagement with said cam, and bias means associated with each valve member to urge said valve member into the closed position when said cam member is released by said pivot link.

6. A system according to claim 1, said valve member characterized by having a closure plate associated with said discharge tube with an outer peripheral flange portion, said activating means operative to move said closure plate through an annular recess in the wall of each discharge tube until said outer peripheral flange portion is aligned with the wall of said tube to completely block the flow of air through said discharge tube.

7. A system according to claim 1, said activating means defined by a solenoid including a plunger operatively connected to said locking means and operative when said plunger is energized to release said locking means from engagement with said mounting means.

8. In an emergency air shutdown system for a diesel engine wherein said engine has an air intake manifold and curved discharge tubes to deliver air into said manifold, said system comprising:

a closure plate for each discharge tube, each said closure plate being of a circular configuration conforming to the cross-sectional configuration of each associated discharge tube and provided with sealing means to form a seal between said closure plate and said tube in the closed position;

means pivotally mounting each said closure plate externally of its associated discharge tube for movement about an axis parallel to the flow of air through an annular recess in the wall of said associated discharge tube between an open position outside the path of air flow and a closed position extending across said tube to block the flow of air therethrough;

releasable locking means retaining each said closure plate in an open position; and activating means for each said plate operative to release said locking means whereby to pivot said closure plate from its normally open position to said closed position.

9. In a system according to claim 8, said locking means for said plate including a cam and a pivot arm engageable with said cam to normally lock it in a position retaining said plate in the open position.

10. In a system according to claim 9, said cam mounted on the pivotal axis of said closure plate and including a shoulder portion thereon, said pivot arm normally engageable with said shoulder portion on said cam to retain said associated closure plate in an open position.

11. In a system according to claim 10, said activating means defined by a solenoid including a plunger engageable with said pivot arm and operative to release said pivot arm from engagement with said cam when said solenoid is energized.

12. In a system according to claim 11, each closure plate including an extension arm mounted for pivotal movement of the pivot pin located externally of each associated discharge tube, a torsion spring on said pivot pin normally urging said closure plate toward the closed position, and said locking means normally retaining said closure plate in the open position against the urging of said torsion spring.

13. In a system according to claim 12, including a return lever operative to overcome the urging of said torsion spring to return said closure plate from the closed position to the open position.

* * * * *

UNITED STATES PATENT AND TRADEMARK OFFICE

CERTIFICATE OF CORRECTION

PATENT NO. : 4,422,418

DATED : December 27, 1983

INVENTOR(S) : Russell J. Dorn

It is certified that error appears in the above-identified patent and that said Letters Patent is hereby corrected as shown below:

Column 1, line 41, cancel "mean" and substitute -- means --.

Column 2, line 56, cancel "tube" and substitute -- turbine --.

Column 3, line 50, cancel "established" and substitute -- establish --.

Signed and Sealed this

*Fifth* Day of *June 1984*

[SEAL]

*Attest:*

GERALD J. MOSSINGHOFF

*Attesting Officer*

*Commissioner of Patents and Trademarks*